United States Patent [19]

Chuan

[11] Patent Number: 5,063,641

[45] Date of Patent: Nov. 12, 1991

[54] BUCKLE FOR LOCKING STRAPS

[76] Inventor: Chiang C. Chuan, 4 Fl., No. 23, Alley 1, Lane 285, Sec. 1, Wen Hua Rd., Taipei Hsien, Taiwan

[21] Appl. No.: 625,463

[22] Filed: Dec. 11, 1990

[51] Int. Cl.[5] ..... A44B 11/00

[52] U.S. Cl. ..... 24/197; 24/68 CD

[58] Field of Search ..... 24/197, 68 CD, 68 CT, 24/69 TM, 69 SB, 71 R, 71 TD, 17 A, 17 B

[56] References Cited

U.S. PATENT DOCUMENTS 2,372,558 3/1945 Dowd ..... 24/69 SB
2,807,852 10/1957 Rane ..... 24/197
4,118,833 10/1978 Knox et al. ..... 24/68 CD
4,185,360 1/1980 Prete, Jr. et al. ..... 24/68 CD

*Primary Examiner*—Victor N. Sakran
*Attorney, Agent, or Firm*—Merchant, Gould, Smith, Edell, Welter & Schmidt

[57] ABSTRACT

A buckle for locking straps used for fastening goods includes a belt having two loop ends each enclosing a pair of rectangular lower and upper rings and a rectangular loosening ring with a flat side. A strap winds each pair of rings. One of said straps encloses the rectangular loosening ring such that it is locked when the loosening ring is in a horizontal position, and is allowed to slacken when said loosening ring is in a vertical position.

1 Claim, 3 Drawing Sheets

BUCKLE FOR LOCKING STRAPS

BACKGROUND OF THE INVENTION

The present invention relates to an economical and light-weight buckle for locking straps used for fastening goods.

Conventionally, goods are bound with a rope made out of jute or the like. A first end of the rope is attached to a hook on a right (or a left) side of a truck or the like. The rope is then wound around the goods and wrapped around a hook on a left (or a right) side of the truck. The rope is finally tied into a knot on a proper hook of the truck. The goods are thus fastened. The trouble with using a rope is that it is a waste of time to wind the rope around and around the goods; it is not always easy to tie a firm knot to secure the goods; and the roughness of the rope can easily damage the goods.

U.S. Pat. No. 4,118,833 discloses a buckle assembly with strap tightening mechanism wherein a padlock is needed to fix a handle member and a main frame in a firm position. Disadvantageously, the cost thereof is high and the weight thereof is substantial that serious damage may occur.

U.S. Pat. No. 4,185,360 discloses a ratchet buckle for tightening and tensioning strap wherein ratchet wheels and two spring-biased latching plates are employed to tighten the strap. It is very difficult to disengage the two latching plates from the ratchet wheels simultaneously, thus, it is very difficult to loosen the strap.

SUMMARY OF THE INVENTION

It is an object of the present invention to provide an easily operated buckle.

It is another object of the present invention to provide a light-weight buckle.

It is still another object of the present invention to provide an economical buckle.

It is yet another object of the present invention to provide a buckle wherein no padlock is needed to hold the whole buckle in a firm position.

It is still another object of the present invention to provide a buckle wherein the whole device can be loosened easily.

These and additional objects, if not set forth specifically herein, will be readily apparent to those skilled in the art from the detailed description provided below, with appropriate reference to the accompanying drawings.

DETAILED DESCRIPTION OF THE PREFERRED EMBODIMENT

Figure 1:
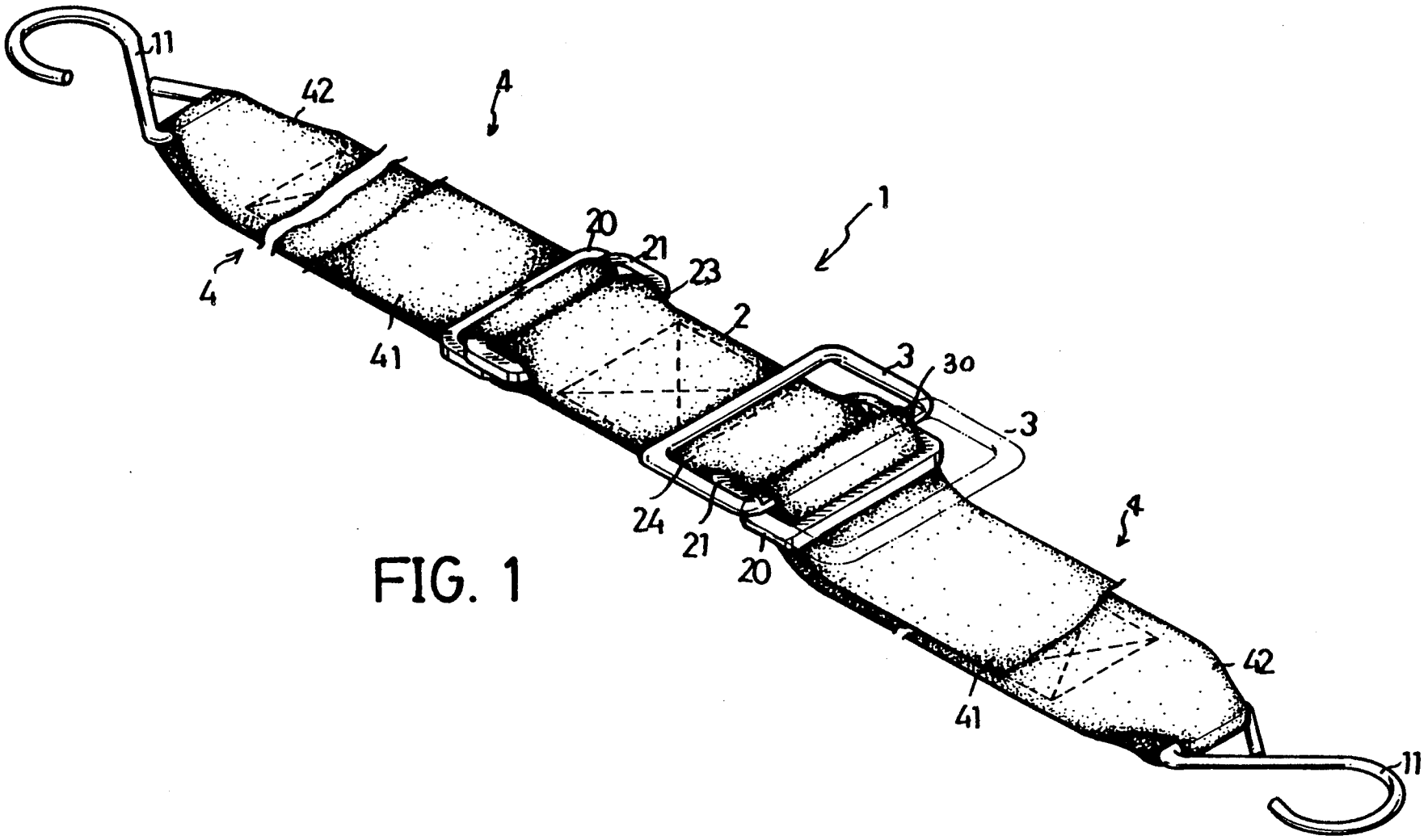
FIG. 1 is a perspective view of a preferred embodiment of a buckle for locking straps according to the present invention.

Referring to FIG. 1, a buckle 1 for locking straps used for fastening goods includes a belt 2 having two loop ends 23 and 24 each enclosing a rectangular lower ring 20 and a rectangular upper ring 21, and a rectangular loosening ring 3 having a long flat side 30.

A strap 4 has a free end 41 and a bound end 42 attached with a hook 11.

Figure 2:
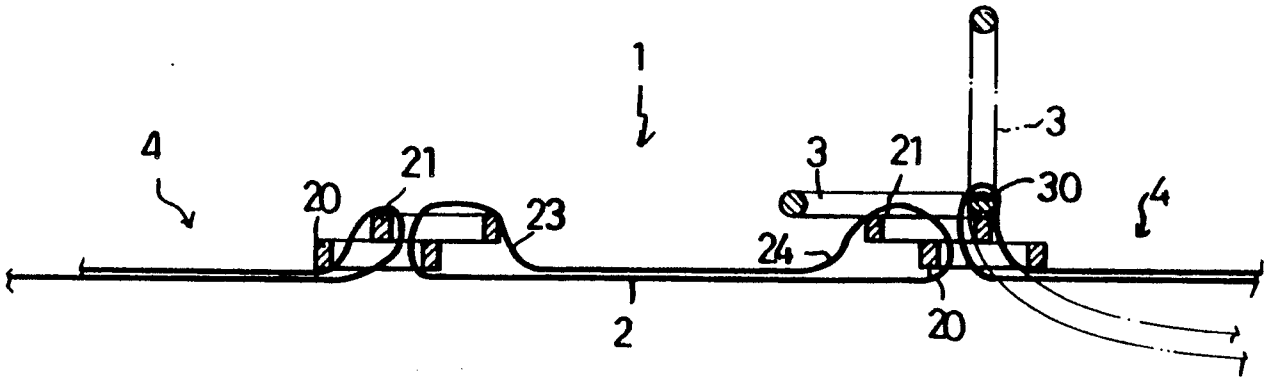
FIG. 2 is a side sectional view of a preferred embodiment of a buckle for locking straps according to the present invention.

Referring to FIG. 2, each pair of rectangular lower and upper rings 20 and 21 are wound by a strap 4. One of the straps 4 further encloses the long flat side 30 of the rectangular lossening ring 3. The strap 4 is secured when the rectangular loosening ring 3 is in a horizontal position, and is allowed to slacken when the rectangular loosening ring 3 is in a vertical position.

Figure 3:
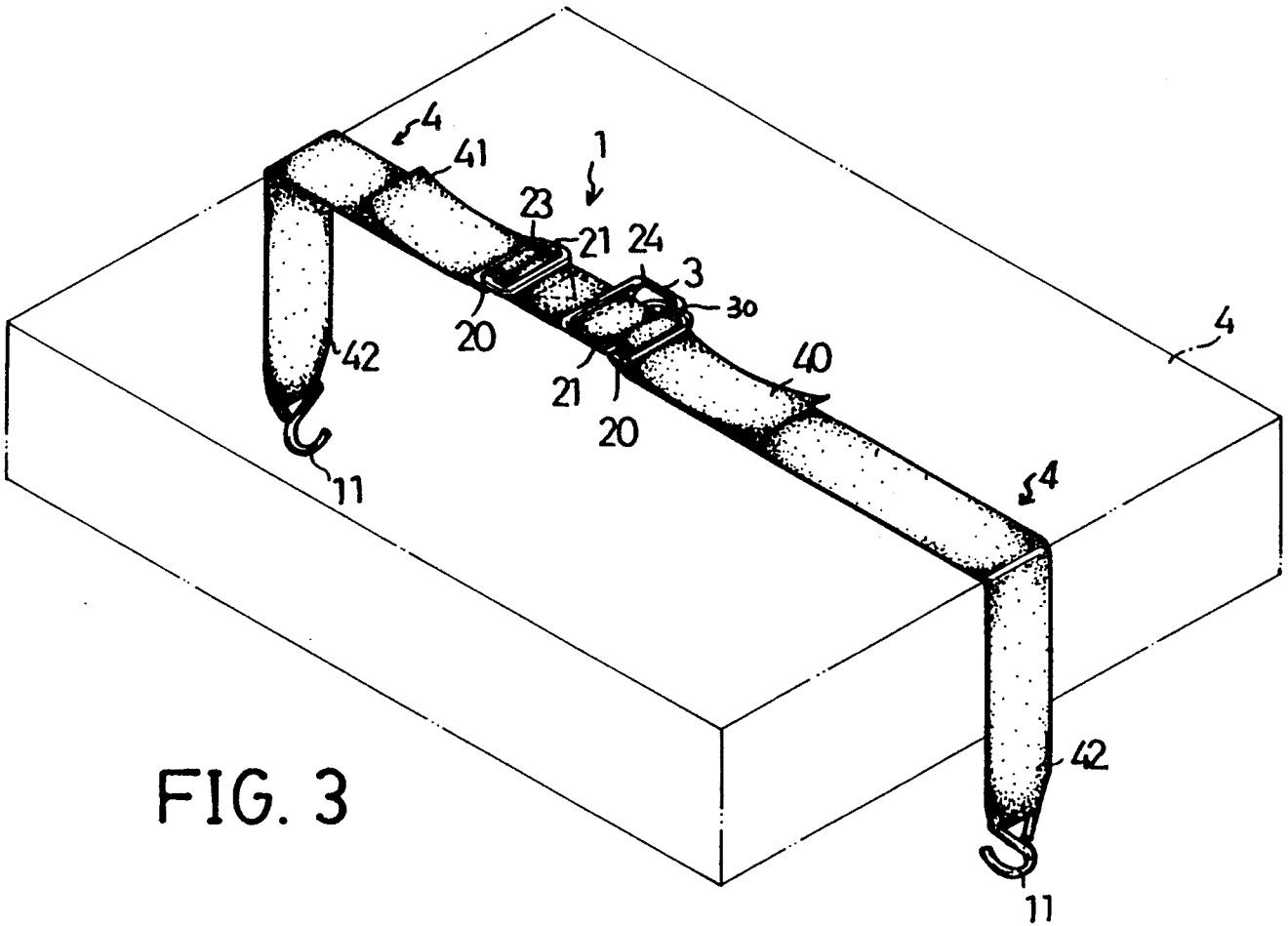
FIG. 3 is a perspective working view of a preferred embodiment of a buckle for locking straps according to the present invention.

Referring to FIG. 3, in operation, the hooks 11 are attached to a truck or the like (not shown). The straps 4 are pulled over the goods and tightened by pulling the free ends 41.

When there is an external load to loosen the strap by pulling the strap 4 at the bound end 42, the ring 21 is urged to push the strap 4 adjacent to the ring 20, thus increasing the friction therebetween. This retains the strap 4 with the desired tension.

When it is desired to loosen the strap 4, the loosening ring 3 is pivoted from a horizontal position to a vertical position, causing the flat side 30 to allow the strap 4 to slacken from the bound end 42 to the ring 3. The strap 4 is thus loosened.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. A buckle for locking straps used for fastening goods comprising:

a belt having two loop ends; an upper rectangular ring and a lower rectangular ring enclosed in each one of said loop ends, and each said lower and upper rectangular rings being wound by a strap for fastening goods; and a rectangular loosening ring having a long flat side being enclosed in one of said straps such that said strap which encloses said long flat side being locked when said loosening ring is in a horizontal position, and said strap being allowed to slacken when said loosening ring is in a vertical position.

* * * * *